United States Patent [19]

Noda et al.

[11] Patent Number: 4,588,879

[45] Date of Patent: May 13, 1986

[54] VACUUM INTERRUPTER

[75] Inventors: Yasushi Noda; Yoshiyuki Kashiwagi, both of Tokyo, Japan

[73] Assignee: Kabushika Kaisha Meidensha, Japan

[21] Appl. No.: 554,122

[22] Filed: Nov. 21, 1983

[30] Foreign Application Priority Data

Nov. 30, 1982 [JP] Japan ..... 57-210512
Nov. 30, 1982 [JP] Japan ..... 57-210513
Apr. 26, 1983 [JP] Japan ..... 58-63728[U]

[51] Int. Cl.[4] ..... H01H 33/66
[52] U.S. Cl. ..... 200/144 B
[58] Field of Search ..... 200/144 B

[56] References Cited

U.S. PATENT DOCUMENTS 3,946,179 3/1976 Murano et al. ..... 200/144 B
4,347,413 8/1982 Watanabe et al. ..... 200/144 B

FOREIGN PATENT DOCUMENTS 57-199126 12/1982 Japan .

*Primary Examiner*—Robert S. Macon

*Attorney, Agent, or Firm*—Lowe, Price, Leblanc, Becker & Shur

[57] ABSTRACT

A vacuum interrupter enhances current interruption capability for large current at high voltage. The interrupter includes a coil-electrode creating an axial magnetic field parallel to the direction of arc current passing across an interelectrode gap. The coil-electrode includes a radially extending web spaced from a contact-electrode of the interrupter, one end of the web electrically connected to a contact-electrode lead rod, a partially turning segment having one end connected through an electrical connector to the other end of the web, another web and a segment made of a material with electrical conductivity higher than the contact-electrode and attached to the back-surface of the contact-electrode. The other web electrically connects the other end of the segment to a contact-making portion of the contact-electrode, the one and other webs alternating at angular intervals. Current passes through the one and other webs in opposite directions. Current paths are shortened in the contact-electrode. The coil-electrode intensifies the axial magnetic field due to the arrangements of the webs.

29 Claims, 19 Drawing Figures

VACUUM INTERRUPTER

BACKGROUND OF THE INVENTION

1. Field of the Invention

This invention relates to a vacuum interrupter used in an electric circuit of high power, for example, with an alternating current circuit, more particularly to a vacuum interrupter of an axial magnetic field appliance type in which a magnetic field is applied in a direction parallel to an axis of an electric arc-current flowing across a space between a pair of contact-electrodes within a vacuum envelope of the vacuum interrupter when the pair is engaged or disengaged (hereinafter, the magnetic field is referred to as an axial magnetic field), thus enhancing current interruption capability of the vacuum interrupter.

2. Description of the Prior Art

A vacuum interrupter of an axial magnetic field appliance type restricts an electric arc to a space between a pair of separated contact-electrodes and uniformly distributes the arc in the space with the axial magnetic field thereof, thus preventing any local overheating of the contact-electrodes to enhance the current interruption capability thereof.

A conventional vacuum interrupter of the axial magnetic field appliance type, as shown in FIG. 1, is known. The interrupter comprises an evacuated envelope 3 including an insulating cylinder 1 and a pair of metallic end plates 2 joined to the opposite ends of the insulating cylinder 1, and a pair of stationary and movable contact-electrodes 4 and 5 within the envelope 3 which are engaged or disengaged to close and open a circuit. The contact-electrodes 4 and 5, which are of a generally disc-shape, each made of Cu, Ag, or alloy thereof of high electrical conductivity. The contact-electrode 4 or 5 is mechanically and electrically connected to the inner end of a stationary or movable lead rod 6 or 7 which extends within the evacuated envelope 3 securing vacuity thereof through an aperture centrally defined in each metallic end plate 2.

Coil-electrodes 8 and 9, each of which creates the axial magnetic field, made of high electrical conductivity material are located spaced from each of the contact-electrodes 4 and 5 therebehind. The stationary and movable contact-electrodes 4 and 5 and the corresponding coil-electrodes 8 and 9 are mechanically connected at the center portion to each other by means of spacers 8*a* and 9*a* of high electrical resistivity material, while electrically connected near the outer peripheral portions to each other by means of high electrical conductors 8*b* and 9*b*.

The coil-electrodes 8 and 9, when the movable contact-electrode 4 is separated from the stationary contact-electrode 5, create a magnetic flux between the contact-electrodes 4 and 5 by a circular current flowing through the coil-electrodes 8 and 9. The magnetic flux is changeable with time and passes the contact-electrodes 4 and 5 from the front surfaces thereof to the backsurfaces thereof or vice versa.

A metallic arc shield 10 of a generally circular cylinder is provided at the insulating cylinder 1, surrounding the contact-electrodes 4 and 5. Further, auxiliary metallic shields 11 are provided on the respective metallic end plates 2 near the opposite ends of the arc shield 10.

A metallic bellows 12 secures a hermetic sealing between the movable lead rod 7 which allows the movable contact-electrode 5 to engage or disengage from the stationary contact-electrode 4, and the corresponding metallic end plate 2.

The above-mentioned vacuum interrupter has a certain advantage in the aspect that the axial magnetic field which is applied to the space between the contact-electrodes 4 and 5 upon occurrence of a circuit interruption, enhances the current interruption capability.

However, according to the vacuum interrupter, the magnetic flux changeable with time which is created by the coil-electrodes 8 and 9 permeates through the stationary and movable contact-electrodes 4 and 5 of high electrical conductivity material, thus creating eddy current in the contact-electrodes 4 and 5 so as to reduce the axial magnetic field by the coil-electrodes 8 and 9.

For eliminating the disadvantages of the contact-electrodes 4 and 5, a pair of stationary and movable contact-electrodes 13 and 14, as shown in FIG. 2, are provided which are different from the contact-electrodes 4 and 5 in the aspect that a plurality of slits 15 are provided extending radially in the contact-electrodes 13 and 14 (Refer to U.S. Pat. No. 3,946,179A).

The contact-electrodes 13 and 14 have a certain advantage in the aspect that they eliminate eddy current in the contact-electrodes 4 and 5 of FIG. 1. However, the slits 15 considerably reduce the dielectric strength between the contact-electrodes 13 and 14 due to edges thereof and also the mechanical strength of the contact-electrodes 13 and 14.

Further, the slits 15 are filled up with deposited arcing products after the stationary and movable contact-electrodes 13 and 14 have interrupted large current at high voltage many times, namely, the contact-electrodes 13 and 14 are returned to a state wherein the contact-electrodes 13 and 14 lack slits. Consequently, the current interruption capability of the contact-electrodes 13 and 14 is considerably reduced.

For eliminating the disadvantages of the contact-electrodes 4, 5, 13 and 14 of FIGS. 1 and 2, a pair of stationary and movable contact-electrodes 16, as shown in FIG. 3, are provided which are different from the contact-electrodes 4 and 5 of FIG. 1 in the aspect that they are made of material of at most 40% IACS electrical conductivity, e.g., Be, Cu-W alloy or Ag-W alloy (refer to JP-57199126A, published on Dec. 7, 1982). According to the pair of contact-electrodes 16 disclosed as a prior art in the JP-57199126A, eddy current created in the contact-electrodes 16 are considerably reduced although the slits are not provided therein. However, if the contact-electrodes 16 are employed together with the coil-electrodes 8 and 9 disclosed in FIG. 1, when an electric arc A is located away from a contact-making portion 17 at the center portion of the contact-electrode 16 before the arc is distributed on the whole surface of the contact-electrode 16, depending upon any outer magnetic field and/or other affections, differences between values of branched arc currents $i_1$, $i_2$, $i_3$ and $i_4$ which, for example, flow in the contact-electrodes 16 from or to the coil-electrode 9 through the high electrical conductor 9*b* are spread because of lowered of electrical conductivity of the contact-electrodes 16, and further the branched arc current $i_1$ is caused to be maximal and finally the branched arc currents $i_2$, $i_3$ and $i_4$ are caused to be substantially zero. Consequently, the magnetic flux density of the located axial magnetic field applied by the branched arc current $i_1$ through flowing the coil-electrodes 8 and 9 to the interelectrode gap is caused to be maximal at the location of the arc and uniformity of the magnetic flux density which is to be produced substantially over the interelectrode gap is considerably impaired. The current interruption capability of the contact-electrode 16 is considerably lowered.

Further, a temperature rising in the contact-electrodes 16 becomes more severe during a normal current flowing because of the low electrical conductivity of the contact-electrodes 16.

SUMMARY OF THE INVENTION

A primary object of this invention is to provide a vacuum interrupter which improves uniformity of a magnetic flux density in an axial magnetic field applied to a space between contact-electrodes when a circuit is interrupted, and which enhances the magnetic flux density.

Another object of this invention is to provide a vacuum interrupter which has an excellent current interruption capability for large current at high voltage. For attaining the above-described objects, this invention comprises an electrically insulating vacuum envelope, a pair of electrically conductive metallic lead rods which are coaxially movable extending into the vacuum envelope from the outside thereof, a pair of contact-electrodes each mechanically and electrically connected to the inner ends of the lead rods, at least one of the contact-electrodes being made of metallic material of at most 40% IACS electrical conductivity and a coil-electrode which is made of metallic material of electrical conductivity higher than that of the contact-electrode and all the portions of which are mechanically and electrically joined to a backsurface of the contact-electrode, applying an axial magnetic field.

Additionally, the invention provides a vacuum interrupter including a vacuum envelope, a pair of separable disc-shaped contact-electrodes each of which has a contact-making portion at its center, a pair of electrical lead rods each of which is connected to each contact-electrode, and a coil-electrode for creating an axial magnetic field substantially parallel to the direction of arc current passing across an interelectrode gap; the coil-electrode provided between at least one contact-electrode of the pair and a corresponding lead rod of the pair, characterized in that the one contact-electrode is made of a material of at most 40% IACS electrical conductivity and in that the coil-electrode includes a second web extending radially thereof and spaced from the one contact-electrode; one end of the second web being electrically connected to the corresponding lead rod, a partially turning segment having one end which is electrically connected by means of electrically connecting means to the other end of the second web, and a first web and the partially turning segment made of a material possessing electrical conductivity higher than that of a material of the one contact-electrode; the first web and the partially turning segment attached to the backsurface of the one contact-electrode, the first web electrically connecting the other end of the partially turning segment to the contact-making portion of the one contact-electrode, current passing through the first and second webs in the opposite directions and in that the first and second webs alternate at angular intervals.

According to the vacuum interrupter of this invention, main current paths in the contact-electrode are reduced so as for electric main current to flow substantially through a thickness of the contact-electrode, which decreases an electric branched current that impairs the axial magnetic field and the uniformity of the magnetic flux density therein, and decreases a temperature rise in the contact-electrodes.

Further, when the interelectrode gap is made larger with a higher interruption voltage of the vacuum interrupter, the enhanced axial magnetic field can be applied.

Still another object of this invention is to provide a vacuum interrupter of which a contact-electrode enhances the current interruption capability for large current at high voltage and durability. For attaining the object, at least one contact-electrode has no slit and a disc-shaped coil-electrode has a plurality of radially extending webs and partially turning segments, each of which circumferentialy extends from an outer end of each web, and a length of the segment is determined at most 75% of a circumferential length between adjacent radially extending webs.

According to the vacuum interrupter of the present invention, the mechanical strength of the contact-electrode is enhanced and the dielectric strength of the interelectrode gap is not reduced in the embodiments of a contact-electrode having no slit. Further a leak current between the opposite radially extending web and partially turning segment is considerably reduced, which enhances the applied axial magnetic field.

DESCRIPTION OF THE PREFERRED EMBODIMENT

Figure 1:
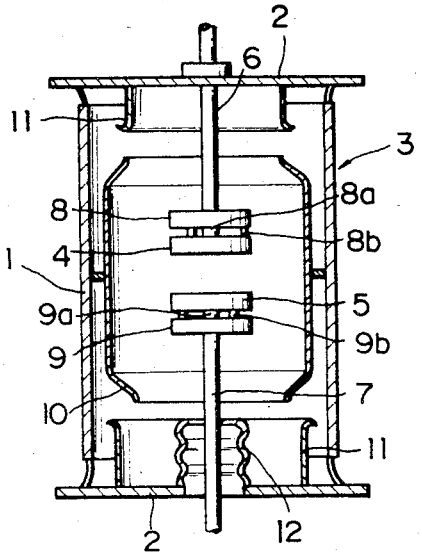
FIG. 1 PRIOR ART
FIG. 1 shows a sectional view through a conventional vacuum interrupter of axial magnetic field appliance type.
Figure 2:
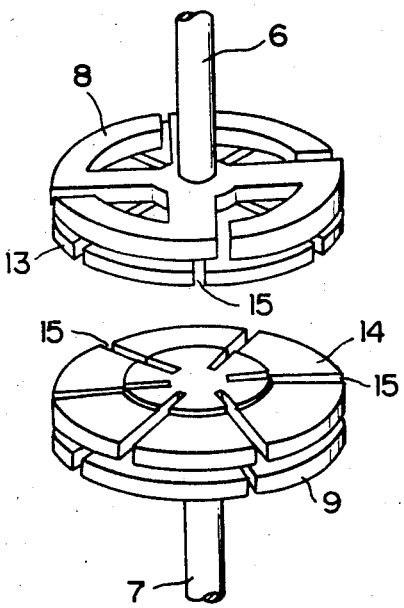
FIG. 2 PRIOR ART
FIG. 2 shows a perspective view of a pair of electrode assemblies of another conventional vacuum interrupter of axial magnetic field appliance type.
Figure 3:
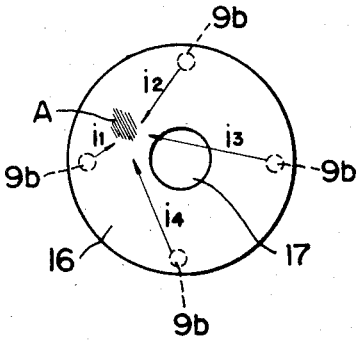
FIG. 3 PRIOR ART
FIG. 3 shows an illustrative plan view of the state in which an electric arc is located by transference on a contact-electrode of still another conventional vacuum interrupter of axial magnetic field applicance type.
Figure 4:
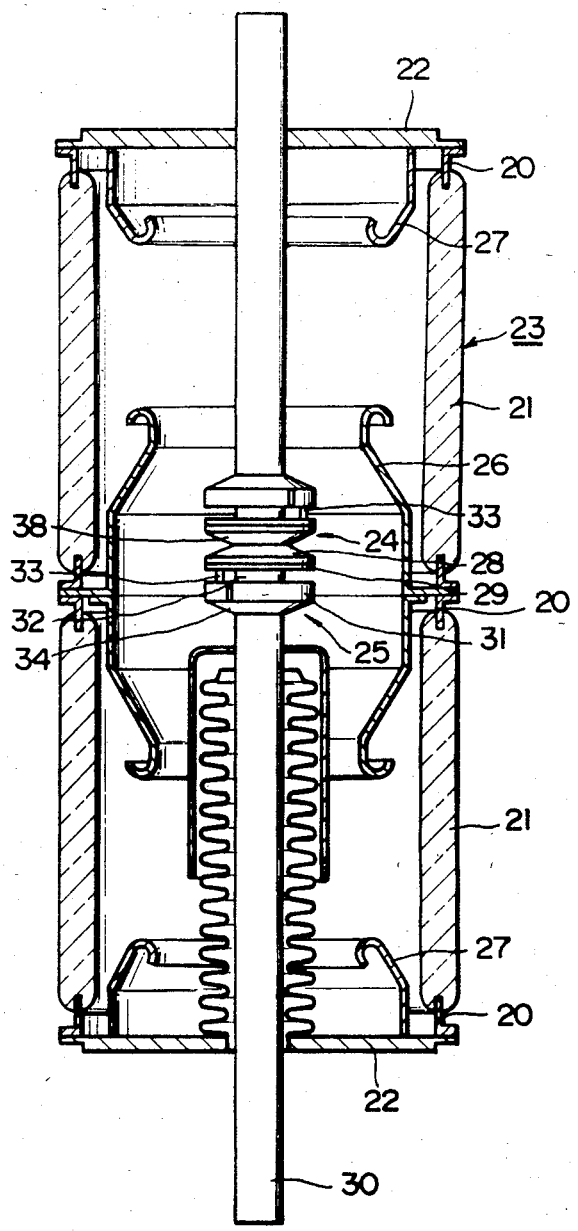
FIG. 4 shows a sectional view through a vacuum interrupter of axial magnetic field appliance type of the first embodiment of this invention.

Referring to FIGS. 4 to 19 of the accompanying drawings, preferred embodiments of this invention will be described in detail. As shown in FIG. 4, a vacuum interrupter of a first embodiment of this invention includes a vacuum envelope 23 and a pair of stationary and movable electrode assemblies 24 and 25 located within the vacuum envelope 23. The vacuum envelope 23 comprises, in the main, two equal insulating cylinders 21 of glass or alumina ceramics which are serially associated by welding or brazing to each other by means of sealing metallic rings 20 at the adjacent ends of the insulating cylinders 21 and a pair of metallic end plates 22 of austinitic stainless steel hermetically associated by welding or brazing to both the remote ends of the insulating cylinders 21 by means of sealing metallic rings 20. A metallic arc shield 26 in the cylindrical form which surrounds the electrode assemblies 24 and 25 is supported on and hermetically joined by welding or brazing to the sealing metallic rings 20 at the adjacent ends of the insulating cylinders 21. Further, auxiliary metallic shields 27 which moderate electric field concentration at edges of the sealing metallic rings 20 at the remote ends of the insulating cylinders 21 are joined by welding or brazing to the pair of metallic end plates 22. The length of each auxiliary shield 27 is determined between 1.1 and 3 times the length of the sealing metallic ring 20.

When the stationary and movable electrode assemblies 24 and 25 are separated from each other, an amount of metallic vapor of arcing products generated in the space between the electrode assemblies 24 and 25 becomes small due to the applied axial magnetic field and the metallic material of at most 40% IACS electrical conductivity of the contact-electrodes 28 and 38. Consequently, the length of arc shield 26 can be reduced and the vacuum gaps between the opposite ends of the arc shield 26 and the auxiliary shields 27 can be increased to have a higher withstanding voltage than the conventional, therefore the insulating cylinders 21 can be in a more shortened form than the conventional at the same withstanding voltage.

Figure 5:
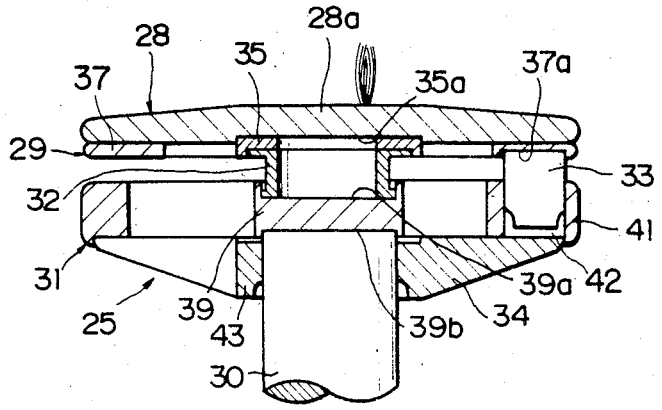
FIG. 5 shows a sectional view through the movable electrode assembly of FIG. 4.

The electrode assemblies 24 and 25 have a common construction and the movable electrode assembly 25 will be described hereinafter. As shown in FIGS. 4 and 5, the movable electrode assembly 25 comprises a movable contact-electrode 28, a first coil-electrode element 29 of which all portions are mechanically and electrically joined to a backsurface of the movable contact-electrode 28, a second coil-electrode element 31 which is mechanically and electrically joined to the inner end of the movable lead rod 30, spaced from the first coil-electrode element 29, a spacer 32 which rigidly connects the central portions of the first and second coil-electrode elements 29 and 31 to each other but substantially electrically insulates from each other the first and second coil-electrode elements 29 and 31, electrical connector 33 in a columnar form which electricaly connects the outer portion of the first coil-electrode element 29 to that of the second coil-electrode element 31, and a reinforcement member 34 for the second coil-electrode element 31.

The above-listed members will be successively described in detail.

As shown in FIG. 5, the movable contact-electrode 28, which is a thinned frustrum of a cone, includes a planar contact-making portion 28*a* at the center of its surface and circular recess 35*a* at the center of its backsurface into which an annular hub 35 of the first coil-electrode element 29 is fitted by brazing.

Further, the movable contact-electrode 28 is made of material of high mechanical strength and low electrical conductivity, e.g., Be, Cu-W alloy, Ag-W alloy, Cu-Cr-Mo alloy or Fe-Ni-Cr alloy. The IACS electrical conductivity of the material is at most 40%. For instance, when the IACS electrical conductivity is about 2%, eddy current in the movable contact-electrode 28, which is created by magnetic flux changeable with time of the axial magnetic field which permeates through the movable contact-electrode 28, is considerably reduced. Further, when the movable contact-electrode 28 is made of material of high mechanical strength and low electrical conductivity, the dielectric strength of the interelectrode gap is enhanced.

Figure 6:
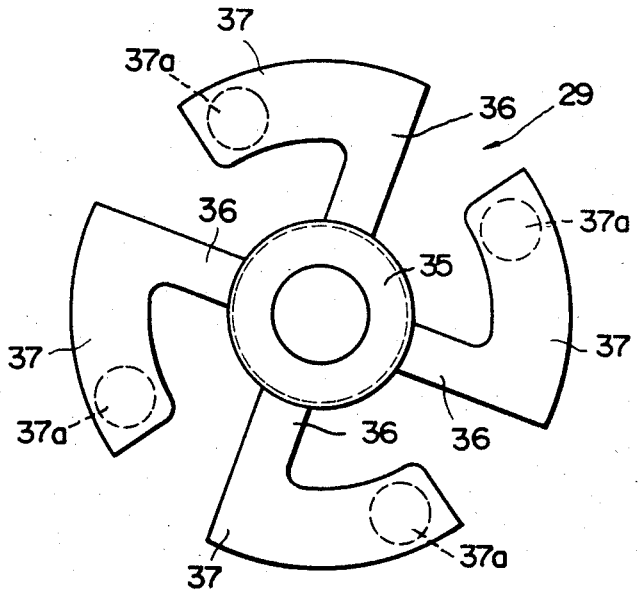
FIG. 6 shows a plan view of the first coil-electrode element of FIG. 5.

The first coil-electrode element 29, an outer diameter of which is usually no more than a diameter of the contact-electrode 28, is made of material of high electrical conductivity such as Cu or Ag or its alloy. Also, the first coil-electrode element 29, as shown in FIG. 6, includes four radially extending webs 36 from the hub 35 at angular intervals of 90 deg. and four partially turning segments 37 extending in the same circumferential direction from the outer ends of the respective radially extending webs 36. The hub 35, radially extending webs 36 and partially turning segments 37, as described above, all are mechanically and electrically joined by brazing to the backsurface of the movable contact-electrode 28. A circular recess 37*a* to which the end of the electrical connector 33 of copper is brazed is provided in the backsurface of the distal end of each partially turning segment 37.

The length of the partially turning segment 37 is determined at most 75% of a circumferential length between adjacent radially extending webs 36. If the percentage is too small or the first coil-electrode element 29 has substantially no partially turning segments 37, the partially turning segments 37 can almost ineffectively generate the axial magnetic field. On the other hand, if the percentage exceeds 75% of the circumferential length, a leak current flows much more between the opposite distal ends of the partially turning segment 37 and the radially extending web 36 by ways of a part of the movable contact-electrode 28, thus reducing significantly the magnetic flux of the axial magnetic field and increasing significantly the phase lag therein. Consequently, even when the electric current in the main circuit comes to a zero current, an arc is maintained across the interelectrode gap between the contact-electrodes 28 and 38 to disable a circuit interruption.

The first coil-electrode 29 is of a ¼ turn type, however may be of a ⅓, ½ or one turn type.

There will be described in detail later a relationship between a ratio of length of the partially turning segment 37 to circumferential length between adjacent radially extending webs 36, and the magnetic flux and the phase lag in the axial magnetic field.

Further, since all the portions of the first coil-electrode element 29 are mechanically and electrically joined by brazing to the movable contact-electrode 28, the enhanced axial magnetic field is created although the interelectrode gap between the contact-electrodes 28 and 38 is increased with withstanding voltage of the vacuum interrupter to that of the conventional vacuum interrupter while a current path in the movable contact-electrode 28 is reduced in length, which contributes to a reduction in the temperature rise in the movable contact-electrode 28.

Figure 7:
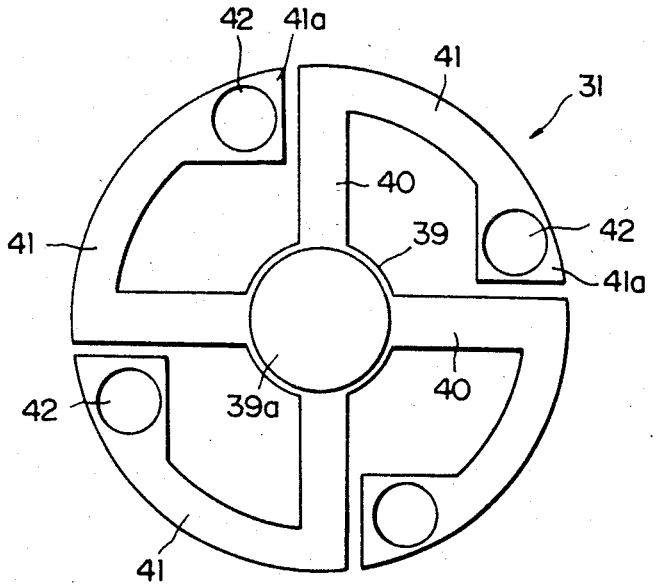
FIG. 7 shows a plan view of the second coil-electrode element of FIG. 5.
Figure 8:
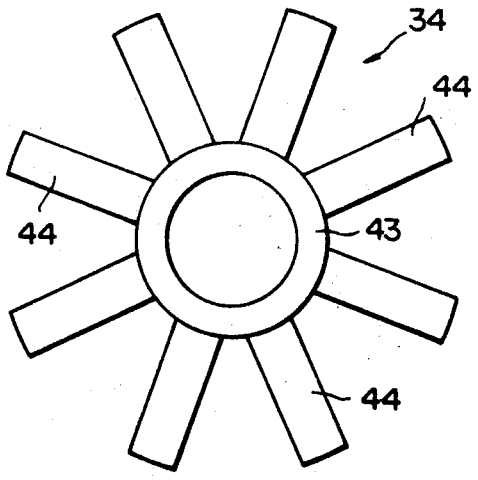
FIG. 8 shows a plan view of the enforcement member.

The second coil-electrode element 31, like the first coil-electrode element 29, is made of material of high electrical conductivity, e.g., Cu and includes, as shown in FIG. 7, four radially extending webs 40 from a hub 39 at the intervals of angle 90° and four partially turning segments 41 extending in the same circumferential direction from outer ends of the respective radially extending webs 40. The direction of extension of the partially turning segments 41 is opposite to the direction of extension of the partially turning segments 37 of the first coil-electrode element 29. A gap is provided between the adjacent distal ends of each partially turning segment 41 and each radially extending web 40. A circular hole 42 to which a part of the electrical connector 33 of copper is fitted and brazed is provided in the distal end of each partially turning segment 41.

A circular recess 39*a* in which the outward extending flange at the one end of the spacer 32 is fitted and brazed is provided in the front surface of the hub 39, while a circular recess 39*b* to which the inner end of the movable lead rod 30 is fitted and brazed is provided in the backsurface of the hub 39.

The second coil-electrode element 31 of FIG. 7 is of a ¼ turn type, however, may be of a ⅓, ½ or one turn type.

Since the first and second coil-electrode elements 29 and 31 are connected by brazing through the electrical connectors 33 to each other for the radially extending webs 36 and 40 not to oppose each other, current flowing between the movable lead rod 30 and the movable contact electrode 28 further flows through the partially turning segments 37 and 41 of the first and second coil-electrode elements 29 and 31 in the same direction to convert into circular currents of at least one effective turn, particularly into circular currents of nearly one and one-half effective turns when the length of the partially turning segments 37 of the first coil-electrode element 29 is about 67% of the circumferential length between the adjacent radially extending webs 36, thus further enhancing the magnetic flux of the axial magnetic field.

The spacer 32 which serves to space the first and second coil-electrode elements 29 and 31 from each other is preferably made of material of as low electrical conductivity and as high mechanical strength as possible. For instance, stainless steel or Inconel may be employed. Alternatively, brazable insulating ceramics of high mechanical strength may be employed.

Further, the spacer 32, which is of a short cylinder having a pair of outward extending flanges at the opposite ends, is fitted and brazed at the flanges to the hubs 35 and 39 of the first and second coil-electrode elements 29 and 31.

The reinforcement member 34, like the spacer 32, is made of material of low electrical conductivity and high mechanical strength, e.g., stainless steel. The reinforcement member 34 includes a hub 43 brazed to the periphery of the movable lead rod 30 and a plurality of supporting arms 44 radially extending from the hub 43. All outer ends of the supporting arms 44 are brazed to the second coil-electrode 31. The supporting arms 44 includes a group of supporting arms 44 which support all the distal ends 41*a* of the partially turning segments 41 of the second coil-electrode 31.

Figure 9:
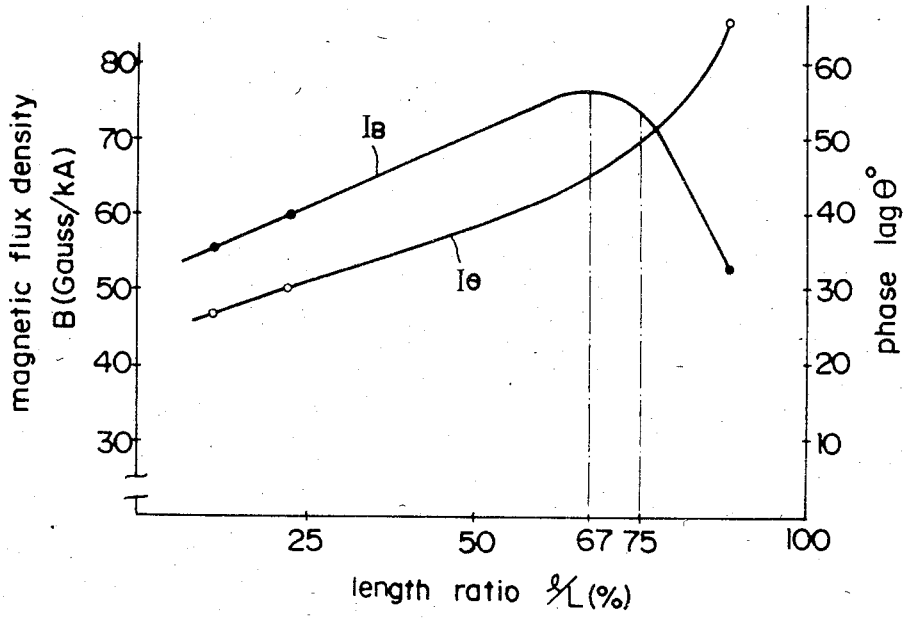
FIG. 9 shows a graph illustrative of a relationship between a ratio of length of a partially turning segment to circumferential length between adjacent radially extending webs of the first coil-electrode element, and magnetic flux density and phase lag in an axial magnetic field.

When there were employed a pair of electrode assemblies each including a disc-shaped contact-electrode of which a diameter had a 100 mm length and IACS electrical conductivity had 35 percentage, and first and second coil-electrodes of a ½ turn type which had an outer diameter as long as a diameter of the contact-electrode, and an interelectrode gap was predetermined to be 15 mm, the magnetic flux density B (Gauss/kA) and the phase lag $\theta$ (degree) at the mid position of the axial magnetic field were measured in respect to a ratio of length 1/L of the partially turning segment length to circumferential length between adjacent radially extending webs of the first coil-electrode element. FIG. 9 shows the result of the measurement. In FIG. 9, the left-hand axis of the ordinate represents the magnetic flux density B and the right-hand axis of the ordinate represents the phase lag $\theta$ to an arc current phase, while the axis of abscissa represents the ratio of length 1/L. Further, in FIG. 9, the curve $I_B$ indicates a relationship between the ratio of length 1/L and the magnetic flux density B of the axial magnetic field, and the curve $I_\theta$, a relationship between the ratio of length 1/L and the phase lag $\theta$ of the axial magnetic field.

It is apparent from FIG. 9 that the magnetic flux density B of the axial magnetic field is maximal at the ratio of length 1/L of about 67%, at which point the rate of increase in the phase lag $\theta$ of the axial magnetic field starts to increase, and further that a rate of decrease of the magnetic flux density B of the axial magnetic field reaches a maximum value at the ratio of length 1/L of about 75%, while a rate of decrease of the magnetic flux density B changes to uniformity at the ratio of length 1/L of about 77%.

Thus, the first coil-electrode 29 of at most 75% of the length ratio will be obtained that is efficient in both the points of the magnetic flux density B and the phase lag $\theta$ in the axial magnetic field.

Now, an electrode assembly of the second embodiment of this invention will be hereinafter described. In the following description, members which are similar to the members of the electrode assemblies 24 and 25 of the first embodiment are chiefly described in the aspects different from the members of the electrode assemblies 24 and 25.

Figure 10:
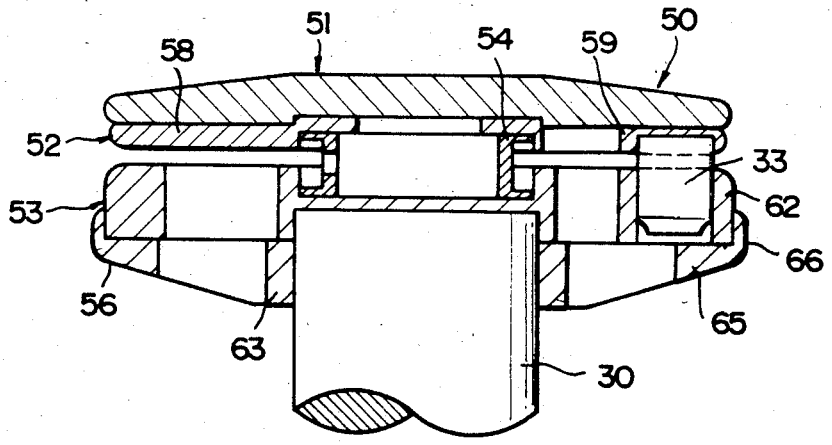
FIG. 10 shows a sectional view through an electrode assembly of the second embodiment of this invention.

As shown in FIG. 10, the electrode assembly 50, like the electrode assemblies 24 and 25, includes a contact-electrode 51, first and second coil-electrode elements 52 and 53, a spacer 54, an electrical connector 33 and a reinforcement member 56.

The above-listed members will be successively described in particular.

Figure 11:
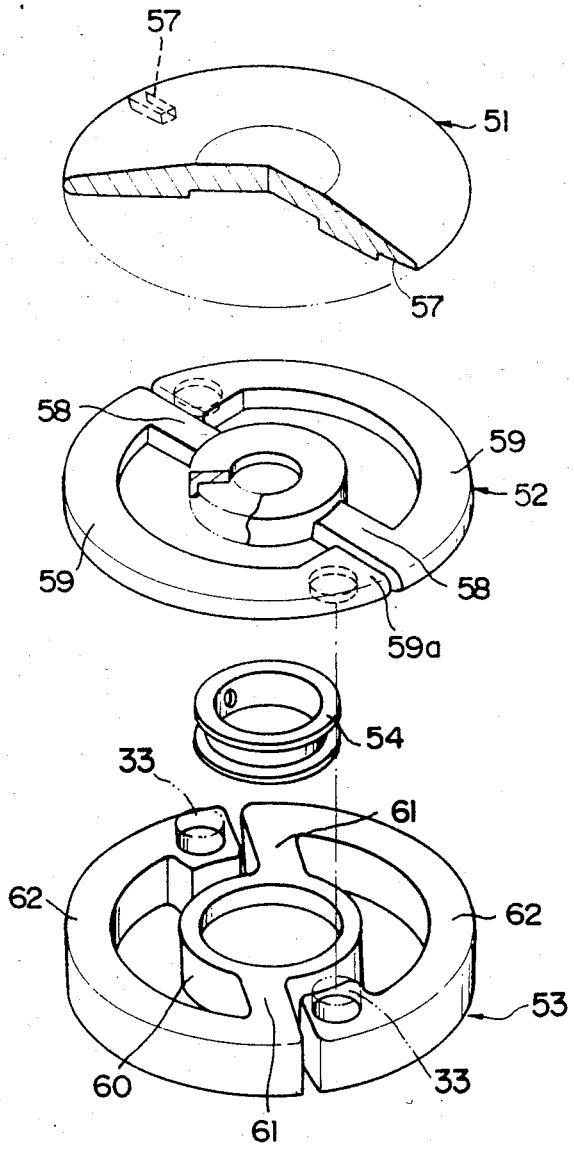
FIG. 11 shows an exploded perspective view of the electrode assembly of FIG. 10.

As shown in FIG. 11, the contact-electrode 51 includes a pair of recesses 57 radially extending from the circumference of the contact-electrode 51 in the back-surface thereof. The recesses 57 correspond to angular gaps between the adjacent radially extending webs 58 and distal ends 59*a* of partially turning segment 59 of the first coil-electrode element 52, thus preventing the adjacent radially extending webs 58 and distal ends 59*a* of the partially turning segments 59 from becoming electrically connected to each other through the shortest path in the contact-electrode 51, in order for the axial magnetic field produced by the first coil-electrode 52 not to be reduced. Therefore, each recess 57 preferably has a length of at least a radial length of the annular gap and a width of at least a width thereof. The length of the recess 57 is about 20% of a radius of the contact-electrode 51. There will be described in detail later a relationship between a ratio of the length of the recesses 57 to the radius of the contact-electrode 51, and magnetic flux density and phase lag in the axial magnetic field.

The contact-electrode 51 is made of material of high mechanical strength and considerably low electrical conductivity, e.g., Cu-Cr-Mo alloy of between 20 and 40% IACS electrical conductivity or Fe-Ni-Cr alloy of at most 20% IACS electrical conductivity.

The first coil-electrode element 52 is of a ½ turn type. The angular gap between each adjacent radially extending web 58 and distal end 59*a* of the partially turning segment 59 is rather smaller than that of the first coil-electrode 29 of the first embodiment. In other words, the length of each partially turning segment 59 is more than 75% of a half of a circumferential length of a circle containing the partially turning segments 59.

The second coil-electrode element 53, like the first coil-electrode element 52, is of a ½ turn type. The second coil-electrode element 53 includes a hub 60, a pair of radially extending webs 61 and a pair of partially turning segments 62.

The spacer 54 is substantially the same as the spacer 32 of the first embodiment.

Figure 12:
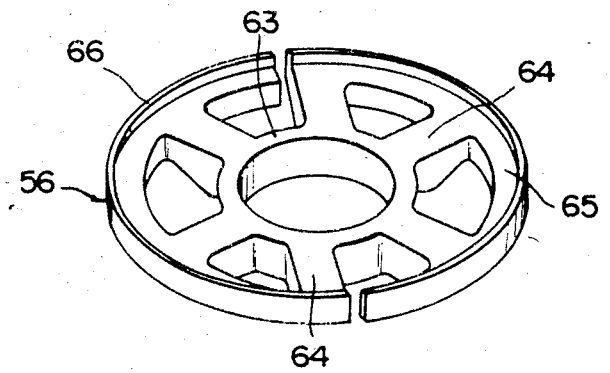
FIG. 12 shows a perspective view of the reinforcement member of FIG. 10.

As shown in FIG. 12, the reinforcement member 56 of which all the portions are joined to the second coil-electrode element 53 includes a hub 63, a plurality of supporting arms 64, a generally annular limb 65 which integrally connects the distal ends of the supporting arms 64. The limb 65 includes two angular gaps at the locations corresponding to the locations of the angular gaps between the adjacent radially extending webs 61 and partially turning segments 62 of the second coil-electrode elements 53. The angular gaps of the reinforcement member 56, like the recesses 57 of the contact-electrode 51, serves to prevent the adjacent supporting arm 64 and end of the limb 65 from being electrically connected to each other through the shortest path in the reinforcement member 56 in order for the axial magnetic field produced by the second coil-electrode element 53 not to be reduced.

The limb 65 includes an upright flange 66 which is fitted and brazed to the outer periphery of the partially turning segments 62 of the second coil-electrode 53.

Figure 13:
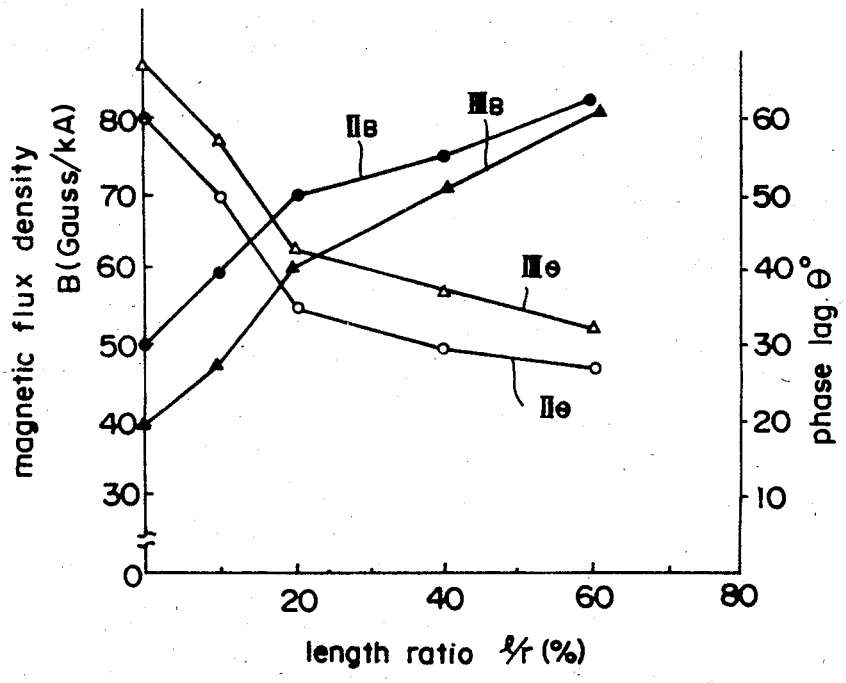
FIG. 13 shows a graph illustrative of a relationship between a ratio of length of a recess to a radius of the contact-electrode of FIG. 11, and magnetic flux density and phase lag in an axial magnetic field.

When there were employed a pair of electrode assemblies each including a disc-shaped contact-electrode of which a diameter had a 100 mm length and IACS electrical conductivity was 2% or 5%, and first and second coil-electrodes of a ½ turn type which had an outer diameter as long as a diameter of the contact-electrode, and an interelectrode gap was predetermined to be 20 mm, the magnetic flux density B (Gauss/kA) and the phase lag $\theta$ (degree) at the mid position of the axial magnetic field were measured in respect to a ratio of length 1/r of the recess to a radius of the contact-electrode. FIG. 13 shows the result of the measurement. In FIG. 13, the left-hand axis of the ordinate represents the magnetic flux density B and the right-hand axis of the ordinate, represents the phase lag $\theta$, while the axis of abscissa represents the ratio of length 1/r. Further, in FIG. 13, the respective polygonal lines $II_B$ and $II_\theta$ *indicate relationships between the ratio of length* 1/r, and the magnetic flux density B and the phase lag $\theta$ of the axial magnetic field when the contact-electrodes have a 2% IACS electrical conductivity, and the respective polygonal lines $III_B$ and $III_\theta$, indicate relationships between the ratio of length 1/r, and the magnetic flux density B and the phase lag $\theta$ in the axial magnetic field when the contact-electrodes have a 10% IACS electrical conductivity.

It is apparent from FIG. 13 that the performance of the contact-electrode of a 2% IACS electrical conductivity is superior to that of the contact-electrode of a 10% IACS electrical conductivity in the aspects of the magnetic flux density B and the phase lag $\theta$ in the axial magnetic field and further that the rate of increase of the magnetic flux density B and the rate of decrease of the phase lag $\theta$ in the axial magnetic field change much from large to small at the ratio of length 1/r of 20% respectively and become substantially uniform in the range of the ratio of length 1/r of at least 20%. Therefore, the length of the recesses in the contact-electrode is allowable to be determined to be the ratio of length 1/r of at least 20% in the aspects of the magnetic flux density and the phase lag in the axial magnetic field.

Now, an electrode assembly of a vacuum interrupter a third embodiment of this invention will be described hereinafter. In the following description, members which are similar to the members of the electrode assembly 50 of the second embodiment are chiefly described in the aspects different from the members of the electrode assembly 50.

Figure 14:
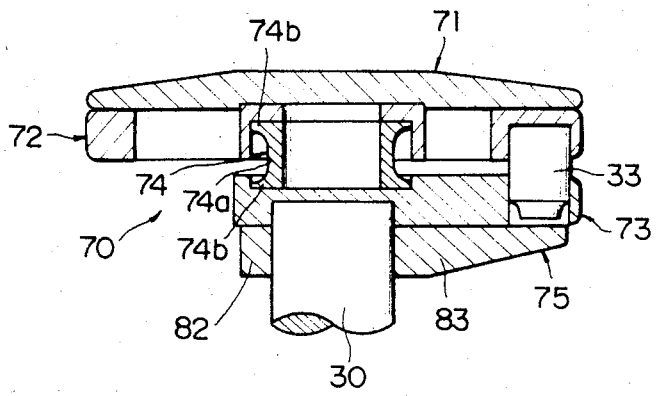
FIG. 14 shows a sectional view through an electrode assembly of the third embodiment of this invention.

As shown in FIG. 14, the electrode assembly 70, like the electrode assembly 50 of the second embodiment, includes a contact-electrode 71, first and second coil-electrodes elements 72 and 73, a spacer 74, electrical connectors 33 and a reinforcement member 75.

The above-listed members will be successively described in particular.

Figure 15:
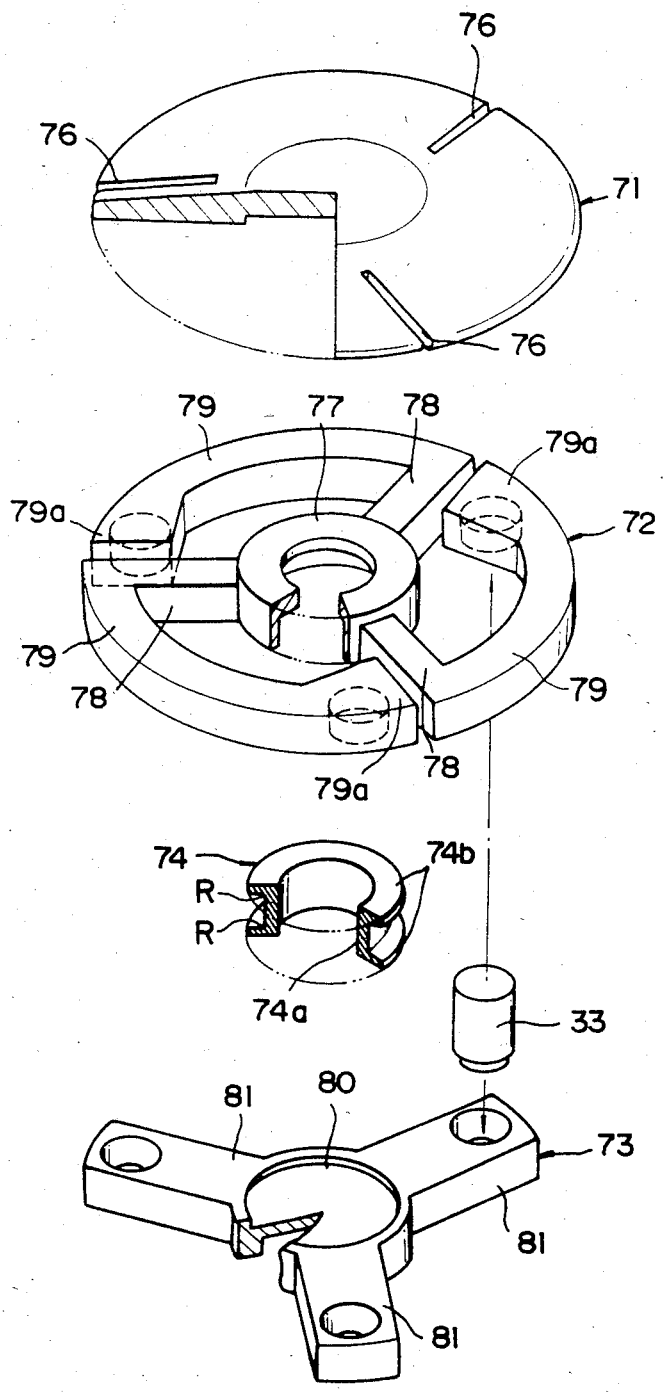
FIG. 15 shows an exploded perspective view of the electrode assembly of FIG. 14.

As shown in FIG. 15, the contact-electrode 71 includes three slits 76 radially extending from the circumference thereof. The slits 76 functions as same as the recesses 57 of the second embodiment. The description of the recesses 57 is generally applicable to the slits 76. However, each slit 76 causes an electrical path between adjacent radially extending web 78 and distal end of a partially turning segment 79 of the first coil-electrode element 72 to be longer than the recess 57, so that a leak current through the path will be reduced, thus enhancing the magnetic flux density B of the axial magnetic field and reducing the phase lag $\theta$ therein.

The first coil-electrode element 72 which is of a ⅓ turn type and shaped much more thickly than the first coil-electrode 52 of the second embodiment includes a hub 77, three radially extending webs 78 and three partially turning segments 79.

As shown in FIG. 15, the second coil-electrode element 73 consists of a hub 80 and three radially extending webs 81 from the hub 80 but includes no partially extending turning segment of a circularly arcuate form. In that point, the second coil-electrode element 78 is of a simple shape and preferred to apply a short length of the space between the contact-electrodes for relatively lower voltage electrical circuit.

The spacer 74 includes the round-cornered boundaries R between the cylindrical body 74*a* and both the outward extending flanges 74*b* at the opposite ends of the cylindrical body 74*a*, which enhances the mechanical strength of the spacer 74.

Figure 16:
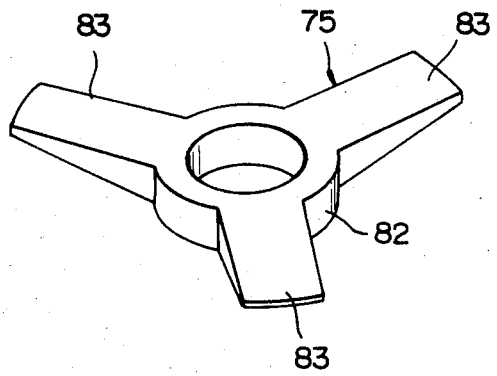
FIG. 16 shows a perspective view of the reinforcement member of FIG. 14.

As shown in FIG. 16, the reinforcement member 75 consists of a hub 82 and three supporting arms 83 radially extending from the hub 82.

Now, an electrode assembly of a vacuum interrupter of the fourth embodiment of this invention will be described hereinafter. The electrode assembly 90 of the fourth embodiment may be said to be a modification to the electrode assembly 24 or 25 of the first embodiment. In the following description, members which are similar to the members of the electrode assembly 24 or 25 are chiefly described in the aspects different from the members of the electrode assembly 24 or 25. The same reference numerals will be used with the same members as the members of the electrode assemblies of the above-described embodiments and the description of the same members will not be repeated.

Figure 17:
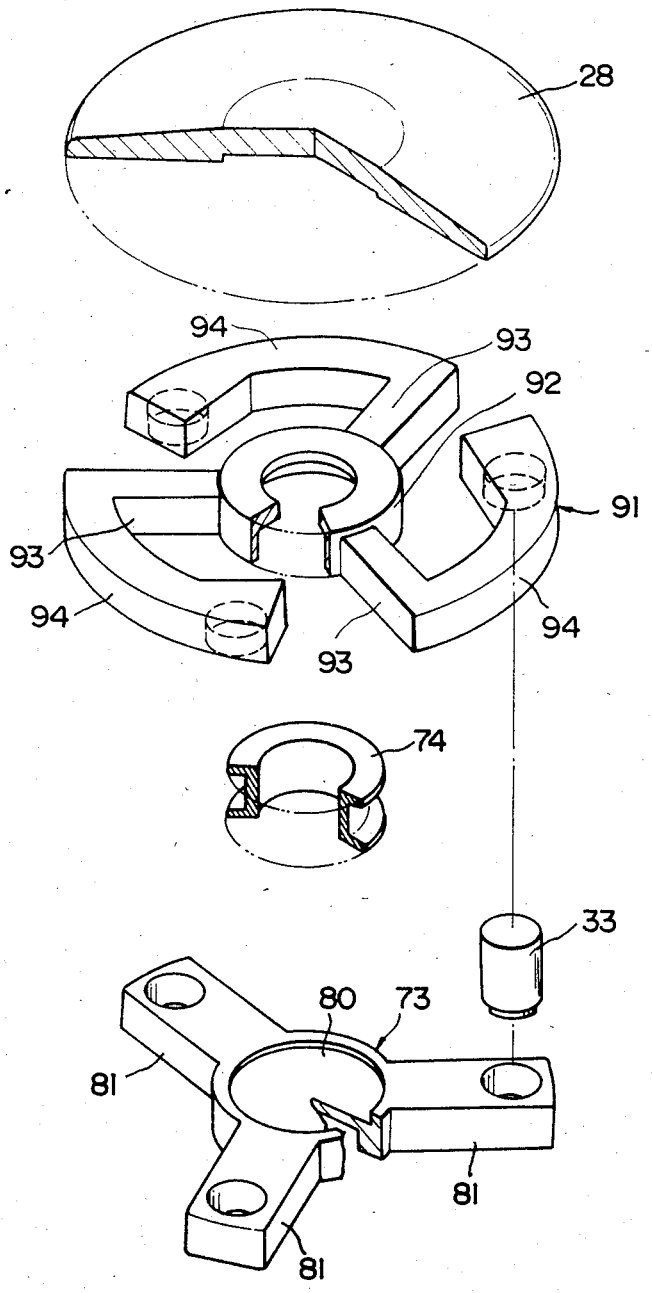
FIG. 17 shows an exploded perspective view of an electrode assembly of the fourth embodiment of this invention.

As shown in FIG. 17, the electrode assembly 90, like the electrode assemblies 24 and 25, includes a contact-electrode elements 28, first and second coil-electrode 91 and 73, a spacer 74, electrical connectors 33 and the reinforcement member 75.

The first coil-electrode element 91 is of a ⅓ turn type and formed much more thickly than the first coil-electrode element of the first embodiment. The first coil-electrode element 91 consists of a hub 92, three radially extending webs 93 and three partially turning segments 94.

Figure 18:
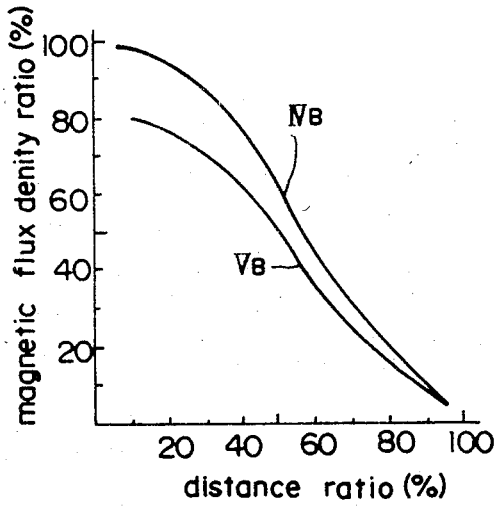
FIG. 18 shows a graph illustrative of a relationship between the magnetic fluxes of an axial magnetic field of the electrode assembly of FIG. 17 and the conventional electrode assembly, and a ratio of a radial distance from the centers of the electrode assemblies to radii of contact-electrodes of the electrode assemblies.
Figure 19:
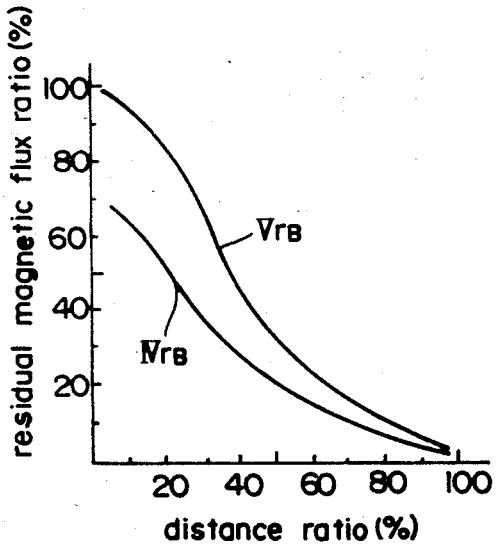
FIG. 19 shows a graph illustrative of a relationship between residual magnetic fluxes of an axial magnetic field of the electrode assembly of FIG. 17 and the conventional electrode assembly, and a ratio of a radial distance from the centers of the electrode assemblies to radii of contact-electrodes of the electrode assemblies.

FIGS. 18 and 19 respectively show the results wherein there are compared with each other, in the aspects of magnetic flux density of an axial magnetic field and residual magnetic flux at a zero current, the electrode assembly 90 of the fourth embodiment and the conventional electrode assembly refer to (U.S. Pat. No. 3,946,179A) including a contact-electrode of the same diameter as that of the contact-electrode 28 and a coil-electrode element of the same outer-diameter as the diameter of the contact-electrode 28. The coil-electrode is provided under the contact-electrode through the vacuum gap.

In FIGS. 18 and 19, the axes of ordinate represent the ratios (%) of the magnetic flux density and the residual magnetic flux of the axial magnetic field by the conventional electrode assembly to the magnetic flux density and the residual magnetic flux of the axial magnetic field by the electrode assembly 90 of the fourth embodiment, while the axes of the abscissa represent the ratios (%) of a distance from the center of the contact-electrode to a radius thereof.

In FIG. 18, the curve $IV_B$ indicates a relationship betwen the magnetic flux density of the axial magnetic field by the electrode assembly 90 and the ratio of the distance from the center of the contact-electrode 28 to the radius thereof, and the curve $V_B$ indicates a similar relationship in case of the conventional electrode assembly.

It is apparent from FIG. 18 that the curve $IV_B$ always locates above the curve $V_B$, namely, the electrode assembly 90 always provides a more enhanced axial magnetic field than the conventional electrode assembly.

It is also apparent from FIG. 19 that the curve $IV_{rB}$ always locates under the curve $V_{rB}$, namely the residual magnetic flux of the axial magnetic field by the electrode assembly 90 is less than the residual magnetic flux of the axial magnetic field by the conventional electrode assembly. Thus, the vacuum interrupter of the fourth embodiment provides a recovery voltage characteristic better than the vacuum interrupter including the convlentional electrode assembly.

In the above-described embodiments, the contact-electrodes are in the form of a thinned frustom of a cone. However, for example the contact-electrodes may be in a form in which a disc-shaped contact-making portion having a flat surface or a recess is provided projecting from a disc-shaped electrode.

In addition to the above-described embodiments, a thickness of the radially extending web of the first coil-electrode may be greater than a width of the radially extending web thereof for the magnetic flux density to be enhanced in the use of large current interruption.

In addition to the above-described embodiments, edges of the reinforcement member may be processed on a beading operation by arc heating for electric field concentration to be modulated.

In addition to the above-described embodiments, the spacer may be directly jointed to the contact electrode but not to the first coil-electrode element.

In addition to the electrode assembly of the second embodiment, supporting arms 64 may be provided at both the free ends of the limb 65 of the reinforcement 56.

What is claimed is:

1. A vacuum interrupter comprising:

a vacuum envelope which is generally electrically insulating;

a pair of lead rods which are relatively coaxially movable extending into said vacuum envelope from the outside thereof, a pair of contact-electrodes each mechanically and electrically connected to inner ends of said lead rods; at least one of said contact-electrodes being made of material of at most 40% IACS electrical conductivity and, a coil-electrode made of material of electrical conductivity higher than the one contact-electrode, all portions of which are mechanically and electrically joined to a backsurface of the one contact-electrode, applying an axial magnetic field in a direction substantially parallel to arc current flowing across an interelectrode gap.

2. A vacuum interrupter defined in claim 1, wherein said coil-electrode is generally disc-shaped and includes a radially extending web from the center of said coil-electrode and a turning segment of a generally annular form extending from an outer end of the radially extending web.

3. A vacuum interrupter defined in claim 1, wherein said coil-electrode is generally disc-shaped and includes a plurality of radially extending webs from the center of said coil electrode and a plurality of partially turning segments each extending substantially in a common circumferential direction from outer ends of the radially extending webs, and wherein angular gaps are defined between ends of the partially turning segments and adjacent radially extending webs.

4. A vacuum interrupter defined in claim 3, wherein said at least one contact-electrode is generally continuous and a length of the partially turning segment is determined at most 75% of a circumferential length between adjacent radially extending webs.

5. A vacuum interrupter defined in claim 4, wherein said length of the partially turning segment is predetermined to be about 67% of the circumferential length between the adjacent radially extending webs.

6. A vacuum interrupter defined in claim 3, wherein the backsurface of said contact-electrode includes a recess corresponding to an angular gap.

7. A vacuum interrupter defined in claim 6, wherein a radial length of said recess is at least 20% of a diameter of the contact-electrode.

8. A vacuum interrupter defined in claim 3, wherein said contact-electrode includes a slit corresponding to an angular gap.

9. A vacuum interrupter defined in claim 8, wherein a length of said slit is at least 20% of a diameter of the contact-electrode.

10. A vacuum interrupter defined in claim 1, wherein said at least one contact-electrode is made of material of at most 20% IACS electrical conductivity.

11. A vacuum interrupter in claim 1, wherein said at least one contact-electrode is made of material of at most 10% IACS electrical conductivity.

12. A vacuum interrupter in claim 1, wherein said at least one contact-electrode is made of material of 2% IACS electrical conductivity.

13. A vacuum interrupter in claim 1, wherein said at least one contact-electrode is made of a metal selected from the group of Be, Cu-W alloy, Ag-W alloy, Cu-Cr-Mo alloy or Fe-Ni-Cr alloy.

14. A vacuum interrupter in claim 1, wherein said at least one contact-electrode includes a planar contact-making portion at the center.

15. A vacuum interrupter in claim 14, wherein said planar contact-making portion includes a recess at the center.

16. A vacuum interrupter in claim 3, further comprising:

a second coil-electrode spaced from the first coil-electrode therebehind, applying the axial magnetic field in conjunction with the first coil-electrode and being electrically connected at a center thereof to said lead rod and connected at a circumference thereof to the partially turning segments of the first coil-electrode.

17. A vacuum interrupter comprising:

a vacuum envelope, a pair of separable disc-shaped contact-electrodes each of which has a contact-making portion at its center, a pair of electrical lead rods respectively connected to said contact-electrodes, and a coil-electrode for creating an axial magnetic field substantially parallel to the direction of arc current passing across an interelectrode gap;

the coil-electrode provided between at least one contact-electrode of the pair and a corresponding lead rod of the pair, wherein the one contact-electrode is made of a material of at most 40% IACS electrical conductivity and wherein the coil-electrode includes a web extending radially thereof and spaced from the one contact-electrode, the end of the web being electrically connected to the lead rod corresponding to the one contact electrode;

a partially turning segment having one end which is electrically connected by means of electrical connecting means to the other end of the web;

another web and a partially turning segment made of a material possessing electrical conductivity higher than that of the one contact-electrode, the other web and the partially turning segment thereof attached to a backsurface of the one contact-electrode, the other web electrically connecting the other end of the partially turning segment to the contact-making portion of the one contact-electrode;

current passing through said web and said other web in opposite directions and wherein the webs alternate at angular intervals.

18. A vacuum interrupter as defined in claim 17, wherein said coil-electrode includes a plurality of webs and a plurality of partially turning segments each of which extends in substantially a common direction along a circumference of the coil-electrode and wherein an angular gap is defined between distal ends of each partially turning segment and an adjacent other web.

19. A vacuum interrupter as defined in claim 18, wherein the one contact-electrode is generally continuous and a length of the partially turning segment is at most 75% of a circumferential distance between adjacent other webs.

20. A vacuum interrupter as defined in claim 17, wherein the backsurface of the contact-electrode has a recess corresponding to the angular gap.

21. A vacuum interrupter as defined in claim 20, wherein a radial length of the recess is at least 20% of a diameter of the contact-electrode.

22. A vacuum interrupter as defined in claim 17, wherein the one contact-electrode is made of material of at most 20% IACS electrical conductivity.

23. A vacuum interrupter as defined in claim 17, wherein the one contact-electrode is made of material of at most 10% IACS electrical conductivity.

24. A vacuum interrupter as defined in claim 17, wherein the one contact-electrode is made of material of 2% IACS electrical conductivity.

25. A vacuum interrupter as defined in claim 17, wherein the one contact-electrode is made of a metal selected from the group of Be, Cu-W alloy, Ag-W alloy, Cu-Cr-Mo alloy and Fe-Ni-Cr alloy.

26. A vacuum interrupter as defined in claim 17, wherein the contact-making portion is planar.

27. A vacuum interrupter as defined in claim 26, wherein a front surface of the contact-making portion has a recess at its center.

28. A vacuum interrupter as defined in claim 18, wherein the contact-electrode has a slit corresponding to the angular gap.

29. A vacuum interrupter as defined in claim 28, wherein a length of the slit is at least 20% of the diameter of the contact-electrode.

* * * * *